US009651042B2

(12) United States Patent
Blank et al.

(10) Patent No.: US 9,651,042 B2
(45) Date of Patent: May 16, 2017

(54) POSITIVE DISPLACEMENT PUMP HAVING AXIAL MOVEMENT COUPLING AND ROTATIONAL DECOUPLING

(71) Applicant: Joma-Polytec GmbH, Bodelshausen (DE)

(72) Inventors: Andreas Blank, Hechingen (DE); Martin Thoma, Riederich (DE); Torsten Helle, Tuebingen (DE); Hans-Peter Ott, Hirrlingen (DE); Bernd Hess, Nuertingen (DE); Benjamin Kawa, Hechingen (DE); Willi Schneider, Bodelshausen (DE)

(73) Assignee: Joma-Polytec GmbH, Bodelshausen (DE)

( * ) Notice: Subject to any disclaimer, the term of this patent is extended or adjusted under 35 U.S.C. 154(b) by 122 days.

(21) Appl. No.: 14/406,548

(22) PCT Filed: Jun. 13, 2013

(86) PCT No.: PCT/EP2013/062278
§ 371 (c)(1),
(2) Date: Dec. 9, 2014

(87) PCT Pub. No.: WO2013/186314
PCT Pub. Date: Dec. 19, 2013

(65) Prior Publication Data

US 2015/0132169 A1 May 14, 2015

(30) Foreign Application Priority Data

Jun. 14, 2012 (DE) ..... 10 2012 210 048

(51) Int. Cl.
*F03C 2/00* (2006.01)
*F03C 4/00* (2006.01)
*F04C 2/00* (2006.01)
*F04C 11/00* (2006.01)
*F04C 2/344* (2006.01)
(Continued)

(52) U.S. Cl.
CPC ..... *F04C 2/3442* (2013.01); *F01C 21/0827* (2013.01); *F04C 14/06* (2013.01); *F04C 2210/10* (2013.01); *F04C 2240/811* (2013.01)

(58) Field of Classification Search
CPC .... F01C 21/0827; F04C 2/3442; F04C 14/06; F04C 2210/10; F04C 2240/811
USPC ..... 418/23, 253, 256
See application file for complete search history.

(56) References Cited

U.S. PATENT DOCUMENTS 4,428,195 A * 1/1984 Linder ..... F04C 28/06 418/23
2006/0133946 A1* 6/2006 Mathers ..... F04C 14/06 418/112

FOREIGN PATENT DOCUMENTS

DE 25 02 184 A1 7/1976
DE 85 17 622 U1 11/1986
GB 1 287 429 A 8/1972
(Continued)

*Primary Examiner* — Theresa Trieu
(74) *Attorney, Agent, or Firm* — Howard & Howard Attorneys PLLC

(57) ABSTRACT

The invention relates to a positive displacement pump, including a pot-shaped housing, a rotor rotatably supported in the housing, and at least one blade movably guided in the rotor, the blade tip of which contacts the inner circumferential wall of the housing and divides the interior into chambers, wherein a locking mechanism that inhibits or brakes the movement of the blade in the rotor is provided.

11 Claims, 12 Drawing Sheets

(51) Int. Cl.
*F01C 21/08* (2006.01)
*F04C 14/06* (2006.01)

(56) References Cited

FOREIGN PATENT DOCUMENTS

| | | | |
|---|---|---|---|
| GB | 2 074 248 | A | 10/1981 |
| GB | 2 176 537 | A | 12/1986 |
| WO | 2005/005782 | A1 | 1/2005 |

* cited by examiner

POSITIVE DISPLACEMENT PUMP HAVING AXIAL MOVEMENT COUPLING AND ROTATIONAL DECOUPLING

CROSS-REFERENCE TO RELATED APPLICATION

This application is based upon and claims priority to German Patent Application No. 102012210048.2, filed on Jun. 14, 2012.

BACKGROUND OF THE INVENTION

1. Field of the Invention

The present invention relates, generally, to pumps and, more specifically, to a displacement pump.

2. Description of the Related Art

Conventional displacement pumps known in the art, and in particular hydraulic pumps, typically include a pot-shaped housing, a rotor that is swivel-mounted in the housing and at least one blade that is guided movably inside the rotor. The blade tip is attached at the inner peripheral wall of the housing and divides the internal space into chambers.

In vehicles, the vacuum pumps generate the vacuum in the brake boosters, and usually move permanently along with the vehicle engine. Depending on the speed, this translates into an energy consumption of several hundreds of watts, even though the vacuum required for braking has already been built up.

In DE 2502 184 A1, a refrigerating compressor with blades has been disclosed, in which the blades when they are in a retracted position in the rotor can be locked by notched extensions provided on the blades.

From DE 8517622 U1, a vane pump is known in which a hook space provided between the blades is pressurized for retracting the blades into the rotor.

While displacement pumps known in the related art have generally performed well for their intended purpose, there remains a need in the art for a displacement pump in which the blades can be easily locked in the rotor.

SUMMARY OF THE INVENTION

The present invention overcomes the disadvantages in the related art in a displacement pump including a pot-shaped housing, a rotor that is swivel-mounted in the housing and at least one blade that is guided movably inside the rotor. The blade tip is attached at the inner peripheral wall of the housing and divides the internal space into chambers when the displacement pump is operating. A locking mechanism inhibits the displacement of the blade inside the rotor by engaging the blade tractionally or frictionally.

In the time period in which the vacuum pump is not required in the vehicle, the locking mechanism, which can be integrated in the rotor, ensures that the displacement pump does not perform any displacement operation and the pump is "switched off" when the rotor is rotating. This occurs in that the blades or sliders available in the displacement pump are locked by the locking mechanism in an idle position, so that the pump is no longer working and the torque and power input of the pump are reduced, except for churning losses and bearing friction losses. This drastic reduction of the energy requirement also results in a considerable reduction of the $CO_2$ emission of the driving combustion engine.

The locking mechanism engages the blade tractionally or frictionally, and not in a positive engagement, such that the retraction and extension movement of the blades can be mechanically decelerated, until the blades assume their retracted position in the rotor and the pump is no longer generating any power. Advantageously, this retraction and locking operation of the blades takes place in a transitional period, which is the period between normal operation of the pump and disconnection of the pump, when the pump is no longer generating any power and the blades are retracted in the rotating rotor and locked in an idle position. Because of the tractional or frictional connection, it can still be ensured that the blades are securely locked in their idle position.

This invention can be applied to all vane pumps or piston valve pumps (static rotary pumps) having any number of blades and working chambers. The principle is not limited to vacuum pumps but can also be applied to pressure pumps, as well as different media, for example, oil or water pumps and the like, if these are permanently moving along, but are not constantly required.

It is of advantage when in the rotor at least two blades arranged in parallel to one another are provided, wherein the blades, respectively, include a first section remaining in the rotor in such a way that the respectively first sections overlap at least sectionwise perpendicularly to the displacement plane of the blades. Each of the blades has at least a second section which comes out of the rotor when the pump is operating. Consequently, the respectively first sections are the sections which remain in the rotor when the blades are retracted. Advantageously, the locking mechanism engages at the respectively first sections of the blades. As a result, especially the locking mechanism can have a small design because the blades engage where they are located in close proximity to one another.

At the same time, the locking mechanism can engage in radial and/or axial direction at the respectively first section of the blade. Also in this respect the locking mechanism can have a comparatively small design.

Advantageously the locking mechanism is arranged in an intermediate space provided between the first sections of the blades and acts when the blades are activated in radial direction on the broadsides of the first sections of the blades facing each other. Because of the fact that the blades are arranged to overlap one another, the locking mechanism can act simultaneously on the broadsides of the blades facing each other.

Furthermore, the locking mechanism can include a flexible blocking element, which is arranged or engages in the intermediate space and which has a recess and an expansion element, which engages in the recess in such a way that when axially displaced the expansion element expands the blocking element in such a way that the blocking element acts on the broadsides of the first sections of the blades facing each other. Thus, it is possible to provide a tractional and frictional connection for locking the blades. At the same time, the recess and/or expansion element can have a v-shaped or cone-shaped design so that, when the expansion element is axially displaced, power deflection in radial direction and/or even power reinforcement takes place, resulting in the fact the blocking element or sections thereof act in radial direction on the blades.

Alternatively, it is also possible that the locking mechanism has a blocking element, which is arranged in axial extension of the blades and which can be axially displaced in such a way that, when axially displaced, the blocking element acts on the front ends of the first sections of the blades arranged in parallel to one another or located in a plane. As a result, the blocking element acts in axial direction on the blades and firmly fixes them.

In one embodiment, the locking mechanism or blocking element is arranged in or at the rotor and rotates with the rotor when the pump is in operation.

To actuate the locking mechanism, it is of advantage when provision is made for a control element on the side of the housing which can be activated in axial direction via a drive system, wherein, in one embodiment, a rotation decoupling and an axial movement coupling are provided between the control element and the locking mechanism.

By the rotation decoupling, it is possible to decouple the rotational movement of the locking mechanism in relation to the non-rotating control element on the side of the housing. In particular, the rotation decoupling can include a ball, which can be arranged, for example, between the control element and the blocking element or between the control element and the expansion element. In an axial forward movement of the control element, the actuating force can be initiated via the ball in the rotating blocking element or expansion element.

The axial movement coupling can be formed by a ring element provided at the control element and an annular groove provided at the expansion element or the blocking element, which receives the ring element, or vice versa. As a result, it is possible that, especially in a reverse movement of the control element for releasing the locking mechanism, the blocking element or expansion element is taken along by the control element. At the same time, it is advantageous, when sufficient clearance is available between the ring element and the annular groove, so as not to establish any physical contact between the ring element and the annular groove when the control element is in an extended position in which the control element acts especially on the ball and the locking mechanism is activated.

In a further development of the invention, the locking mechanism is provided in the rotor and/or at least in a cover which closes the internal space at the front end. As a result the locking mechanism engages radially and/or axially at the blade and blocks its radial displacement in the rotor.

Advantageously, the locking mechanism is driven and/or activated mechanically, pneumatically, hydraulically, magnetically and/or electromagnetically. In this way, it is possible to provide a simple and cost-effective control system and fast drive system.

It is possible that the locking mechanism is activated when the blade assumes its maximum retracted position in the rotor. As a result, the blade tip ends flush with the outer circumference of the rotor. Then the rotor continues to rotate virtually idle.

In order to reactivate the displacement pump, the locking mechanism is in one embodiment, deactivated when the rotor assumes a rotary position in which the blade tip of the locked blade shows the least distance from the inner peripheral wall of the housing. Usually, this is the case when the rotor assumes the rotary position in which the blade was locked, so that the blade tip touches down gently on the inner peripheral wall and can glide along the inner peripheral wall.

As mentioned above, the locking mechanism engages radially and/or axially at the blade. The axial locking operation takes place via the cover(s) at the front end and the radial locking operation takes place directly at the rotor.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
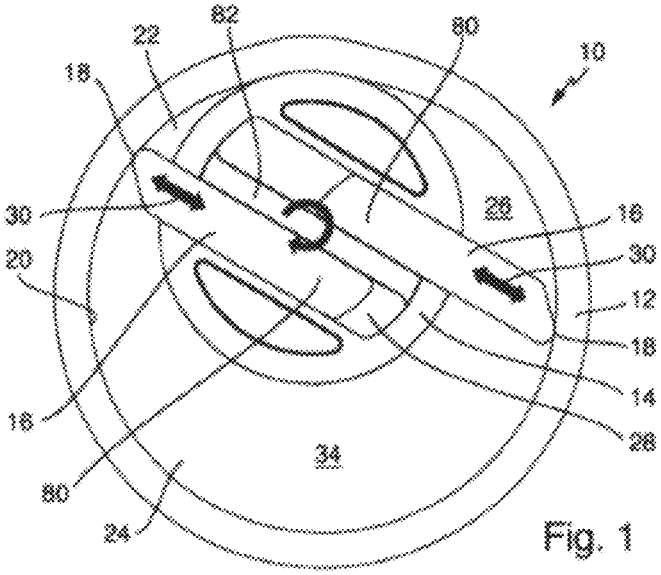
FIG. 1 shows a top view on a displacement pump designed in the form of a vane pump and having a deactivated locking mechanism.

With reference now to the drawings, FIG. 1 shows a displacement pump 10, which is designed in the form of a vane pump and which has a housing 12 in which a rotor 14 is swivel-mounted. Two blades 16 are movably guided in the rotor 14 so that the blade tips 18 touch the inner peripheral wall 20 of the housing 12. The blades 16 divide the internal space 34 of the housing 12 into chambers 22, 24 and 26, wherein in the case at hand chamber 22 depicts a pressure chamber and chamber 26 a suction chamber. During the rotation operation of the rotor 14, the blades 16 perform translational movements (indicated by the arrows 30) inside the rotor 14, i.e., in vane shafts 28.

Figure 2:
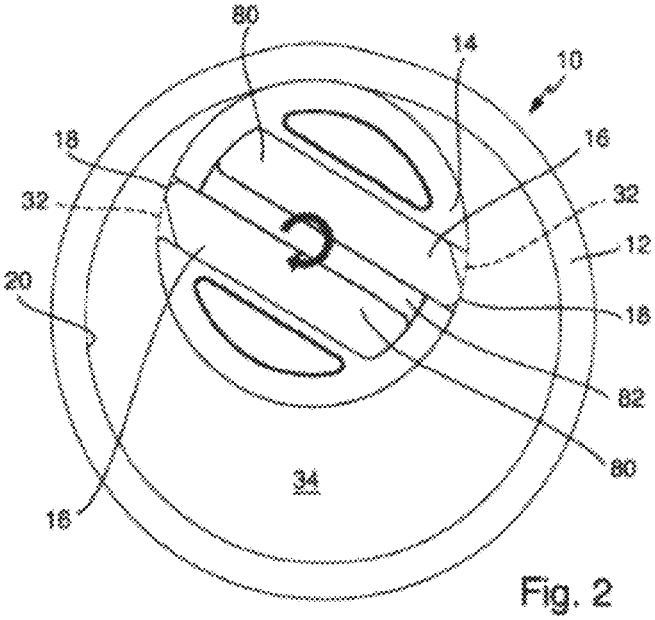
FIG. 2 shows a top view of the displacement pump of FIG. 1 having an activated locking mechanism.

FIG. 2 shows the displacement pump 10 as shown in FIG. 1, wherein the blades 16 are completely retracted in the rotor 14 and the blade tips 18 are located on or within the circumference 32 of the rotor 14. The blades 16 no longer divide the internal space 34 into chambers. The position of the blades 16 is retained in a locking mechanism (as shown in FIGS. 3-8).

FIGS. 1 and 2, as well as other figures, show that the blades 16 are arranged in the rotor 14 in parallel to one another. Each blade 16 has a first section 80, which remains in the rotor 14, especially when the blades 16 are retracted, wherein, as shown in FIG. 2, the sections overlap at least sectionwise perpendicularly to the displacement plane of the blades 16. Between the two blades 16 or their sections 80, there is an intermediate space 82, in which advantageously the locking mechanism 36 can be situated (embodiments as shown in FIGS. 3 to 8).

Figure 3:
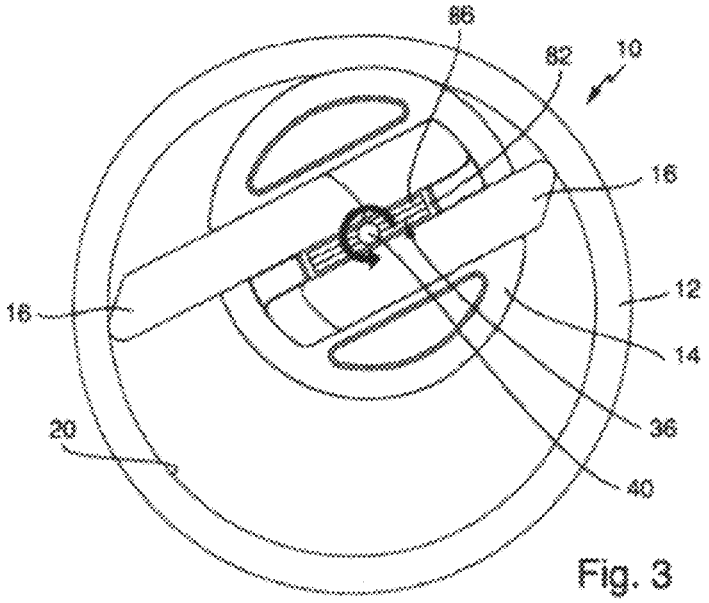
FIG. 3 shows a top view on a displacement pump having a tractional radial locking mechanism.
Figure 4:
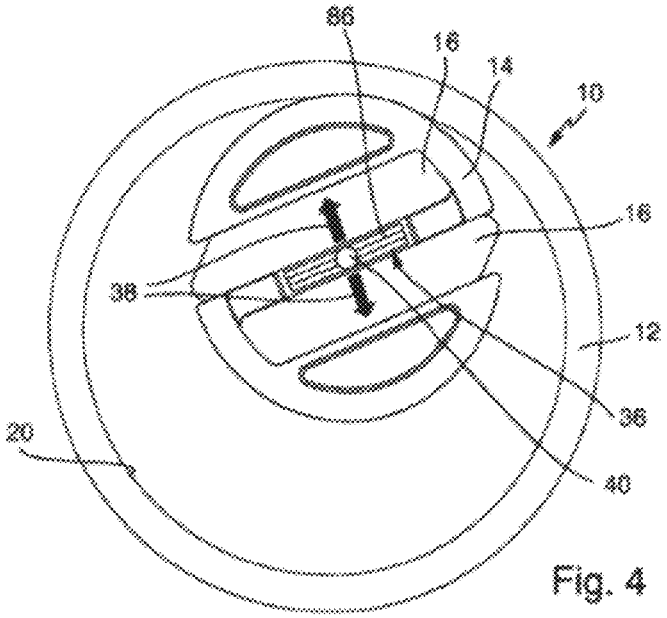
FIG. 4 shows a top view on a displacement pump having a tractional radial locking mechanism.
Figure 5:
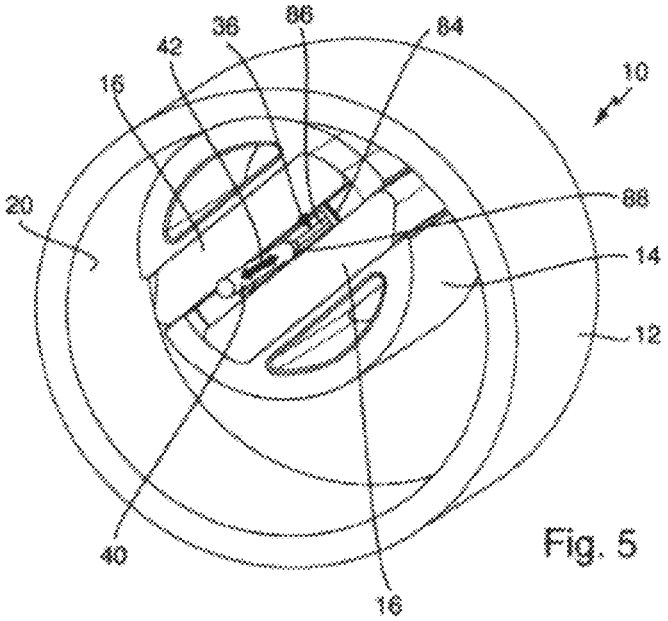
FIG. 5 shows a perspective view of the displacement pump of FIG. 4 having a mechanical control system.
Figure 6:
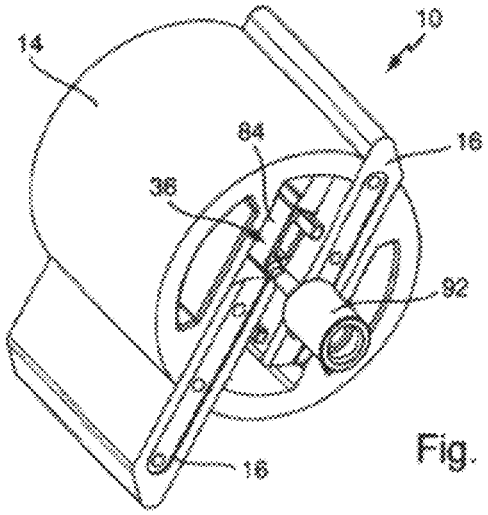
FIG. 6 shows an embodiment of the pump of FIG. 5.

In FIGS. 3 to 8, the displacement pump 10 has a locking mechanism 36 provided in the intermediate space, which locking mechanism 36 acts radially on the blades 16 and operates tractionally. FIGS. 4 and 5 show that the locking mechanism 36 ensures that the blades 16 are retained in the rotor 14 when the displacement pump 10 is not needed. The blades 16 are retained in a non-use position, for example, in that the blades 16 are mechanically jammed (arrow 38) radially in a tractional or frictional connection that they can no longer be forced to the outside against the inner peripheral wall 20.

The locking mechanism 36 includes a blocking element 84 arranged in the intermediate space 82, which in particular can include a flexible plastic material. In the embodiment as shown in FIGS. 3, 4 and 5, the blocking element 84 has on its upper surface (shown in FIGS. 3, 4 and 5) a recess 86 in the form of a taper groove, which extends in longitudinal direction of the blocking element 84.

A control element 40, which can be displaced along its longitudinal axis or the arrows 42, engages in the taper groove. In the embodiment shown in FIGS. 3 to 5, the control element 40 has a cone-shaped tip 88 facing the blocking element 84. The tip 88 engages in the recess 86 in such a way that the blocking element 84 is expanded radially to the outside when the control element 40 is displaced in axial direction into the intermediate space 82, thus fixing tractionally the blades 16 in the rotor 14 in the region of the sections 80.

FIGS. 6 to 9*b* show a further development of the embodiment as shown in FIGS. 3 to 5, wherein the respective components are provided with the appropriate reference numerals.

Figure 8:
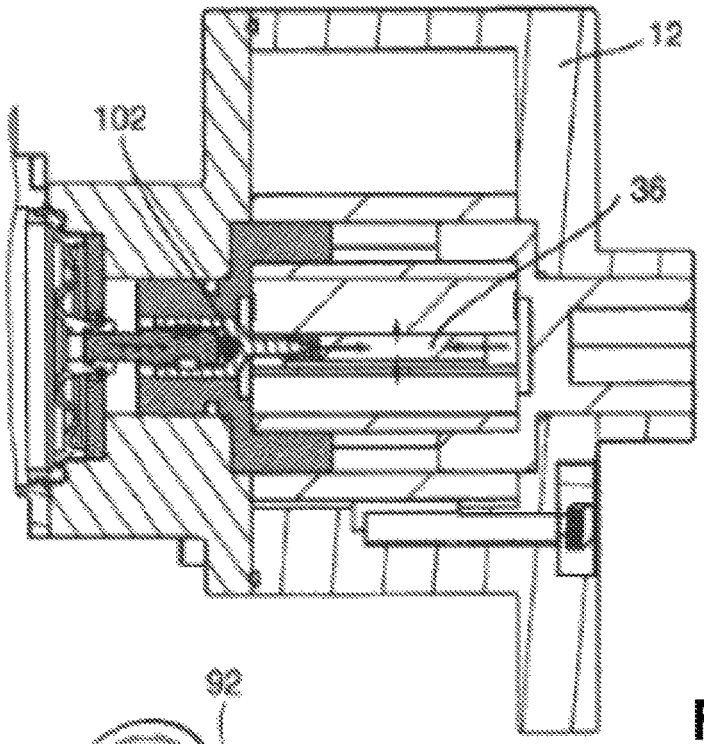
FIG. 8 shows a longitudinal section of the pump of FIG. 6 when the locking mechanism is activated.
Figure 9A:
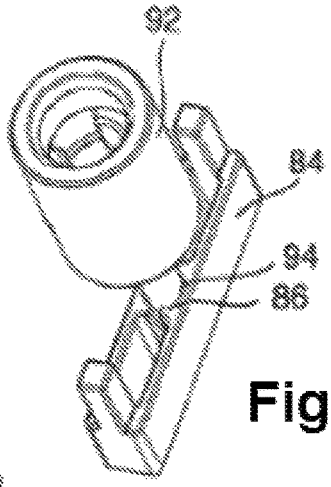
FIG. 9A shows a perspective view of the expansion element and the blocking element of FIGS. 7 and 8.
Figure 9B:
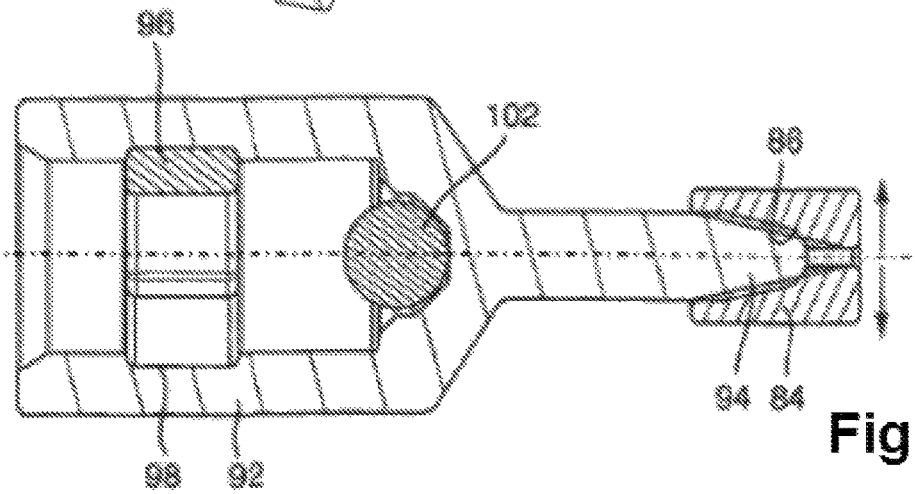
FIG. 9B shows a longitudinal section through the expansion element and the blocking element of FIG. 9A.
Figure 10:
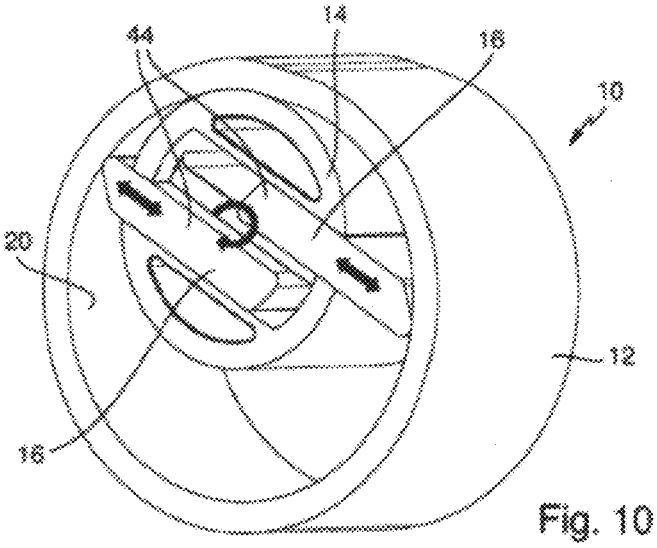
FIG. 10 shows a perspective view of the displacement pump having a tractional axial locking mechanism which is deactivated.

FIGS. 9*a* and 9*b* also show that a blocking element 84 is available in the intermediate space 82. FIGS. 8, 9*a* and 9*b* show that in addition to the control element 40 which can be displaced in axial direction via a drive system 90, the embodiment as shown in FIGS. 6 to 9*b* has an expansion element 92 which is coupled in movement in axial direction with the control element 40. The expansion element 92 is coupled in movement in axial direction with the control element 40. However, the expansion element 92 is rotationally decoupled from the control element 40.

Figure 7:
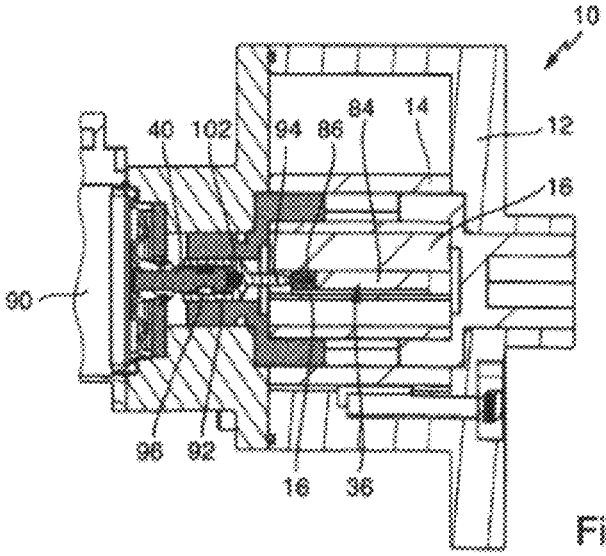
FIG. 7 shows a longitudinal section of the pump of FIG. 6 when the locking mechanism is deactivated.

FIG. 7 shows the control element 40 in its retracted position. As a result, the locking mechanism 36 is deactivated. In FIG. 8, the drive system 90 is activated. Consequently, the control element 40 is extended. As a result, the locking mechanism 36 is activated.

FIG. 9*b* shows that the free end 94 of the expansion element 92 facing the blocking element 84 has a cone-shaped design. FIGS. 9*a* and 9*b* also show that the free end 94 engages in a recess 86 of the blocking element 84 which also has a cone-shaped design. As a result, the blocking element 84 is expanded in radial direction when the expansion element 92 or its end 94 is retracted in axial direction. As shown in FIG. 8, the blades 16 are fixed frictionally or tractionally in their position.

The expansion element has a first sleeve-like section which receives the control element 40. The expansion element 92 has a pin section with the free end 94 on the side facing the blocking element 84. A ring element 96 is arranged in the radially inner region of the sleeve-like section. A ball 102 is arranged in the bottom area of the sleeve-like section.

For an axial movement coupling of the control element 40 and the expansion element 92, the ring element 96 is provided between the control element 40 and the expansion element 92, wherein the ring element 96 is sectionwise situated in one embodiment with large clearance in an annular groove 98 on the side of the expansion element 92 and sectionwise in one embodiment with large clearance in an annular groove 98 situated on the side of the control element 40. As a result, especially when retracting the control element 40 into the position shown in FIG. 7, the expansion element 42 is taken along.

Furthermore, a ball 102 is provided for rotational decoupling in axial direction between the control element 40 and the expansion element 92. This allows the expansion element 92 to rotate in relation to the control element 40, especially in the retracted position of the control element 40 shown in FIG. 8 in which the expansion element 92 rotates with the rotor 14. The arrangement is made in such a way that in one embodiment in the region of the ring element 96 no physical contact takes place between the control element 40 and the expansion element 92 when the locking mechanism 36 is activated. As a result, the expansion element 92 can rotate comparatively contact-free in the region of the ring element 96 in relation to the control element 40.

Consequently, the embodiment as shown in FIGS. 6 to 9*b* functions in the following way:

Based on FIG. 7, the drive system 90 is actuated. The drive system 90 can involve a pneumatic drive system or a magnetic drive system which causes the control element 40 to be extended in axial direction. In FIG. 7, the control element 40 is retracted. Therefore, the expansion element 92 arranged at the control element 40 has no physical contact with the rotor 14 or the blocking element 84 arranged in the rotor 14 between the blades 16. If now the control element 40 is moved into the position as shown in FIG. 8, the free end 94 of the expansion element 92 submerges into the recess 86 of the blocking element 84. Because of the physical contact between the expansion element 94 and the blocking element 84, the expansion element 92 starts to rotate with the rotor 14. Via the ball 102 a rotation of the expansion element 92 takes place, wherein at the same time, power is transmitted in axial direction from the control element 40 to the blocking element 84. When the free end 94 of the expansion element 92 submerges again into the recess 86, the blocking element 84 is expanded in radial direction. The axial force is deflected in a radially effective force. Depending on the inclination of the cones, it is possible to reinforce the power in radial direction.

The radial force generates a friction force which inhibits the movement of the blades 16. Because of the fact that the rotor continues to rotate, the free ends of the blades 16 are gliding along the inner peripheral wall 20, thus automatically moving the blades 16 into the rotor 14. Because of the tractional or frictional connection of the blocking element 84, the blades 16 are retained in the rotor 14. As a result, the locking mechanism 36 is activated; the pump 10 is deactivated and does not supply any power when the rotor 14 is rotating.

To resume the operation of the pump 10, the control element 40 is retracted in axial direction into the position shown in FIG. 7. Because of the translational movement coupling, the expansion element 92 is retracted in axial direction by the ring element 96. In operation, the free end 94 is disengaged from the recess 86 of the blocking element. As a result, the expansion element 92 is no longer driven rotationally by the blocking element 84. It stops to rotate.

Because of the elastic flexibility of the blocking element 84, the tractional or frictional connection with the blades 16 is released in radial direction. As a result, the blades 16 can freely move again in the rotor 14. The pump 10 starts to perform again.

Figure 11:
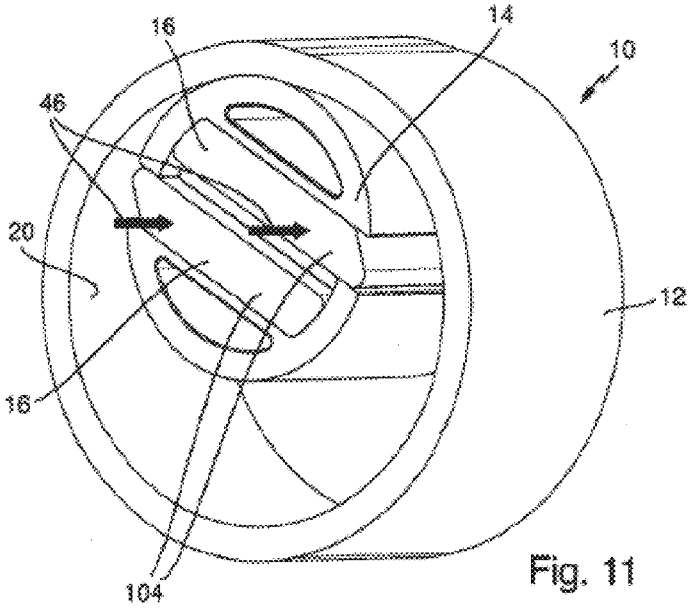
FIG. 11 shows a perspective view of the displacement pump of FIG. 10 having an activated locking mechanism.

In the embodiments shown in FIGS. 1 to 13, the displacement pump 10 has a locking mechanism 36 which acts axially on the blades 16 and operates tractionally or frictionally. As shown in FIG. 11, the locking mechanism 36 ensures that the blades 16 are retained in the rotor 14 when the displacement pump 10 is not needed. For example, the blades 16 are retained in that they are mechanically jammed axially to the extent that they can no longer be forced to the outside against the inner peripheral wall 20. Control takes place via a mechanical force which acts in the direction of the arrows 46 on the front ends 104 of the blades 16, thus locking the blades 16 in the rotor 14.

Figure 12:
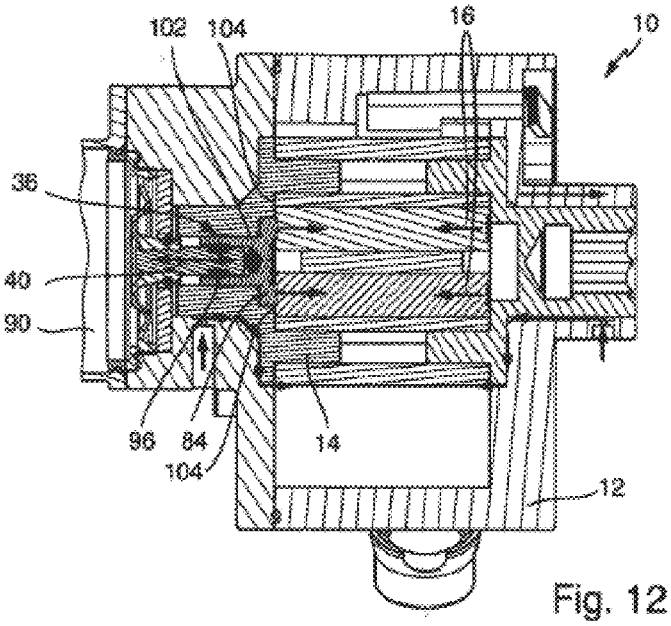
FIG. 12 shows a longitudinal section through the pump of FIG. 11.
Figure 13:
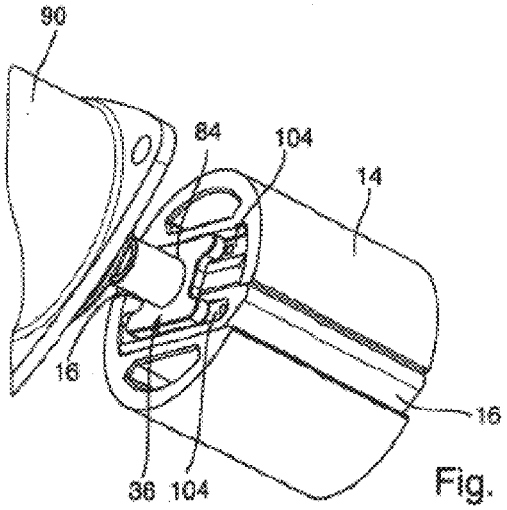
FIG. 13 shows a perspective view from FIG. 12.

FIGS. 12 and 13 show such specification, wherein components already shown in the preceding figures are identified with the appropriate reference numerals.

FIGS. 12 and 13 clearly show the blocking element 84 which has a plate-like design. The blocking element 84 has a first sleeve-like section for receiving the free end of the control element 40. On the surface facing the blades 16, the blocking element 84 has a plate-like design so that it can act on the front ends 104 of the blades 16, which are arranged next to one another in a plane. As a result, the blades 16 are retained tractionally or frictionally and actively locked in the rotor 14.

The blocking element 84 is activated in axial direction by the control element 40 of the drive system 90. At the same time, the control element 40 is coupled in movement in axial direction with the blocking element 84 and rotationally decoupled (via the ring element 96 and the ball 102, as described in FIGS. 6 to 10 with regard to the control element 40 and the expansion element 92).

If now the control element 40 is displaced from its axially retracted position by actuating the drive system 90 into its axially extended position, the blocking element 84 is impinged in axial direction against the front ends 104 of the blades 16. As a result, the blades 16 can be fixed in the rotor 14.

Because of the fact that the blocking element 84 is housed in the rotor 14, it is also rotating with the rotor 14. The rotation decoupling can be provided by the ball 102, so that power can be transmitted in axial direction despite the fact that the blocking element 84 is rotating and the control element 40 is not rotating.

The control element 40 is retracted in axial direction so as to deactivate the locking mechanism 36. Via the ring element 96, the control element 40 takes along the blocking element 84 in axial direction. Then the blocking element 84 is lifted off the front ends 104 of the blades 16. The blades 16 are now able to freely move in the rotor 14. As a result, the pump 10 is activated again.

Figure 14A:
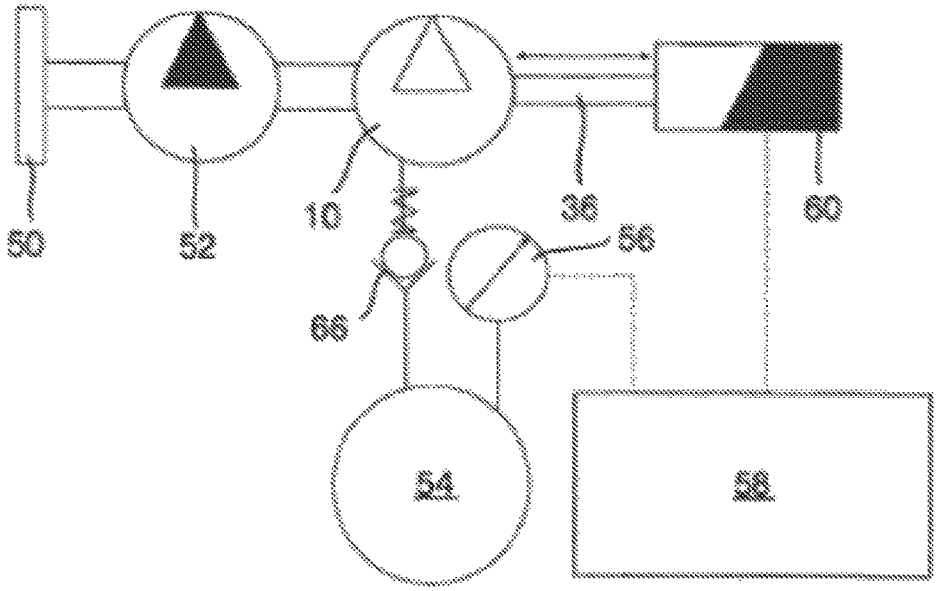
FIG. 14A shows a diagram for controlling electromagnetically the locking mechanism when using an oil pump.
Figure 14B:
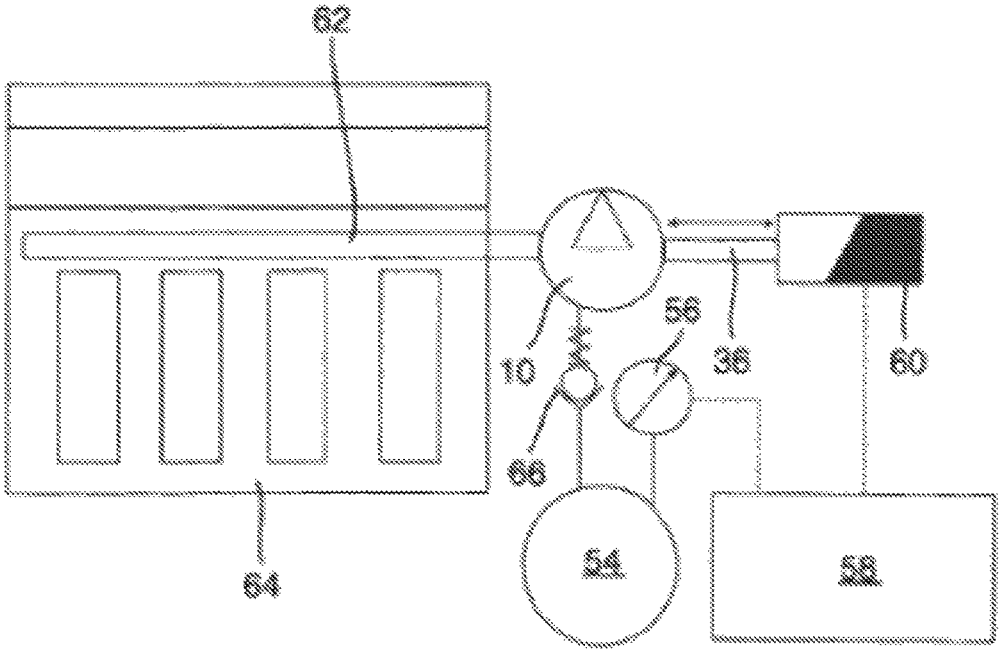
FIG. 14B shows a diagram for controlling electromagnetically the locking mechanism when using a camshaft.

FIGS. 14*a* and 14*b* show a diagram for an electromagnetic control system of the locking mechanism 36. Via a drive shaft 50 (camshaft 62 of an engine 64) a lubrication pump 52 is actuated which, in turn, actuates the displacement pump 10 and supplies a brake booster 54 with low pressure. The pressure in the brake booster 54 is acquired by a sensor 56 and transmitted to control electronics 58 which, on its part, controls an electromagnet 60. The electromagnet 60 actuates the locking mechanism 36 which acts on the blades 16 in the displacement pump 10. As soon as a predetermined low pressure has been reached in the brake booster 54, the locking mechanism 36 is activated and the blades 16 are blocked in the rotor 14. A return valve 66 prevents a reduction of the pressure in the brake booster 54.

Figure 15A:
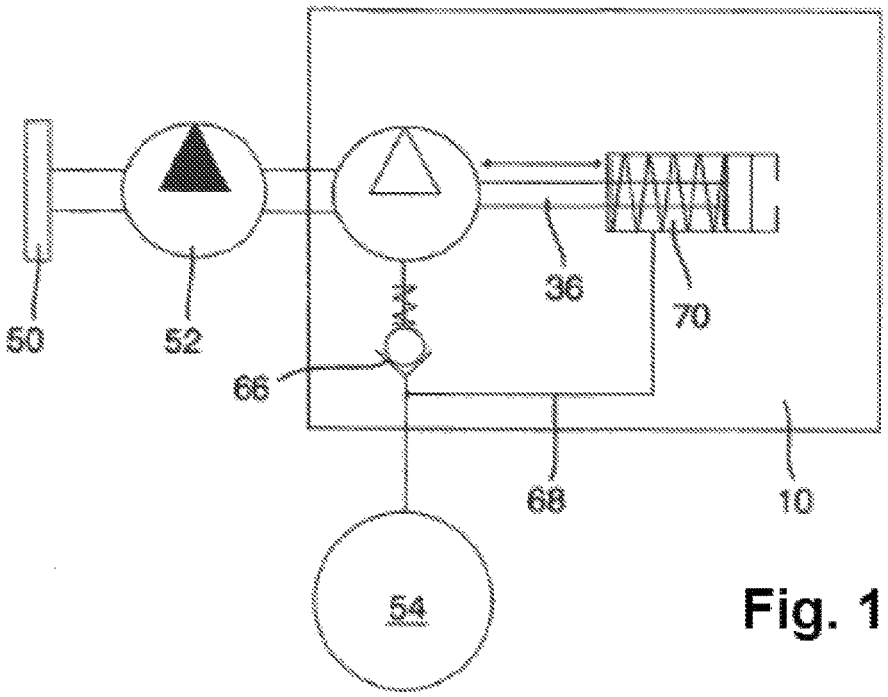
FIG. 15A shows a diagram for internally controlling pneumatically the locking mechanism by a vacuum when using an oil pump.
Figure 15B:
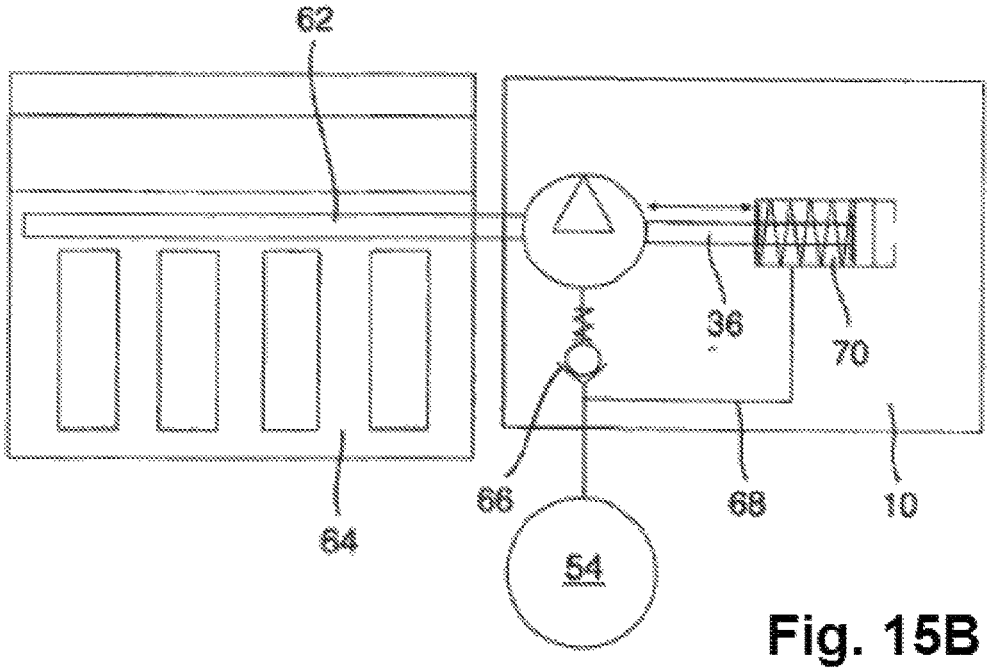
FIG. 15B shows a diagram for internally controlling pneumatically the locking mechanism by a vacuum when using a camshaft.

FIGS. 15*a* and 15*b* show a diagram for an internal pneumatic actuation of the locking mechanism 36. The pressure in the brake booster 54 is directly transmitted via a line 68 to an internal pneumatic vacuum control 70 which, on its part, actuates the locking mechanism 36 which, in turn, acts on the blades 16 in the displacement pump 10. The reference numeral 10 refers to the displacement pump as a whole.

Figure 16A:
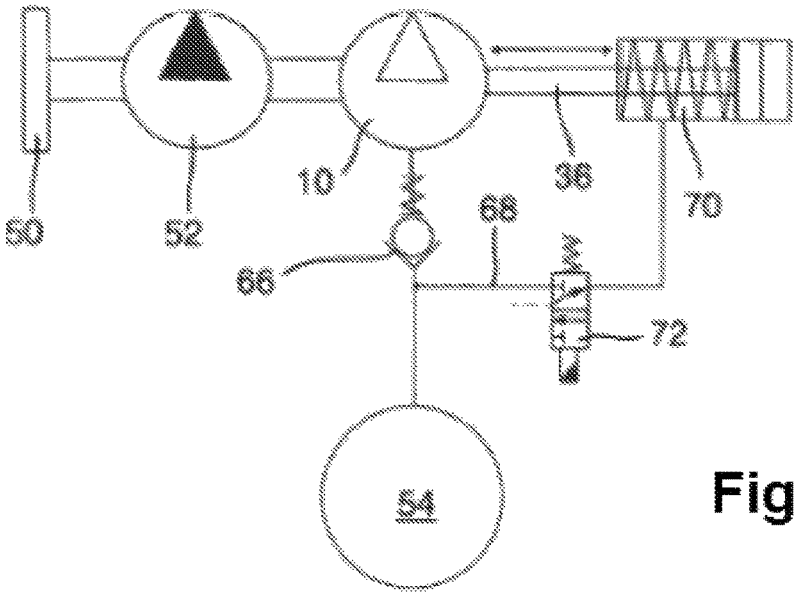
FIG. 16A shows a diagram for externally controlling pneumatically the locking mechanism by a solenoid valve when using an oil pump.
Figure 16B:
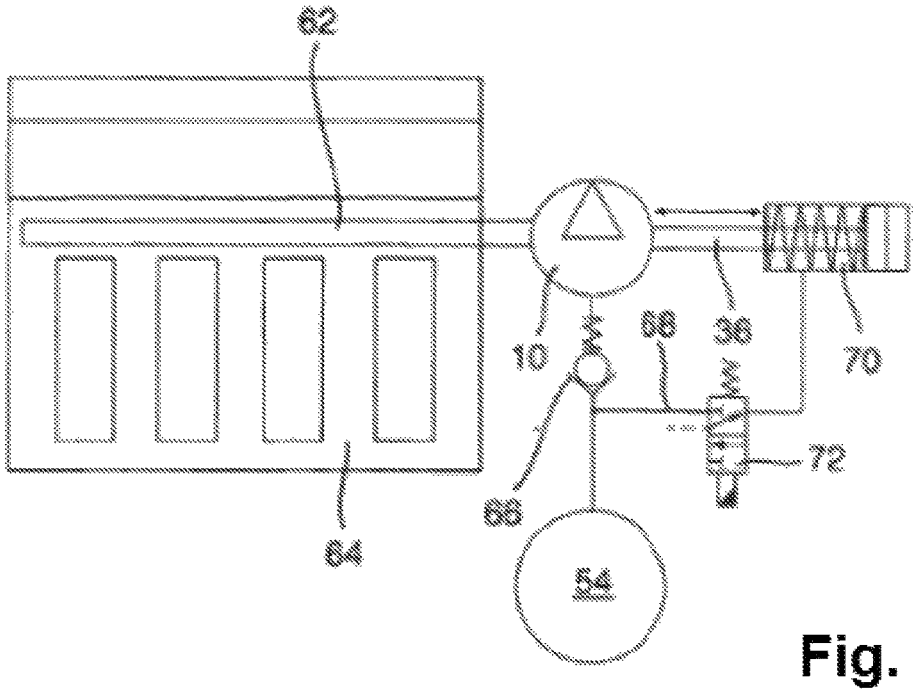
FIG. 16B shows a diagram for externally controlling pneumatically the locking mechanism by a solenoid valve when using a camshaft.

FIGS. 16*a* and 16*b* show a diagram for an external pneumatic control system of the locking mechanism 36. The pressure in the brake booster 54 is transmitted via the line 68 to an external magnetic valve 72, which controls the pneumatic vacuum control 70 which, on its part, actuates the locking mechanism 36 which, in turn, acts on the blades 16 in the displacement pump 10.

Figure 17A:
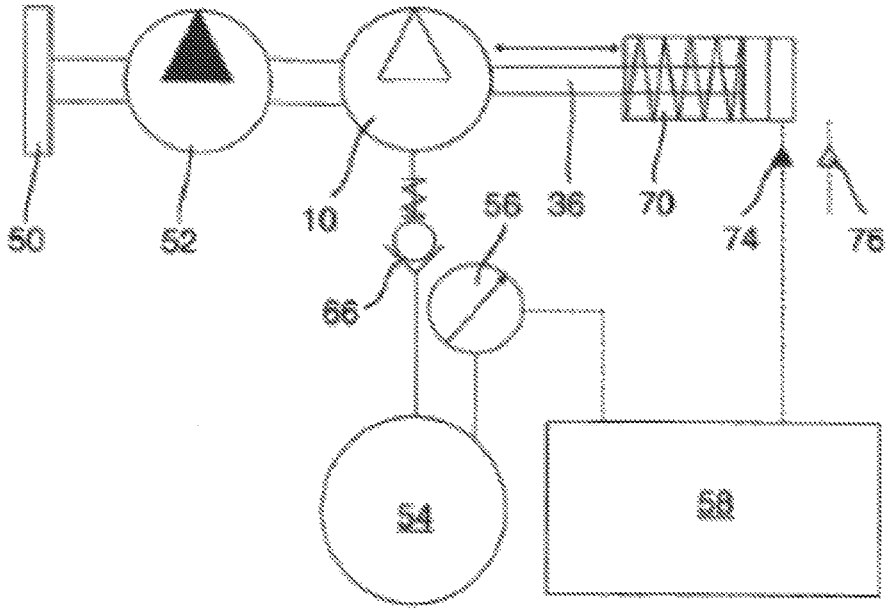
FIG. 17A shows a diagram for externally controlling hydraulically or pneumatically the locking mechanism when using an oil pump.
Figure 17B:
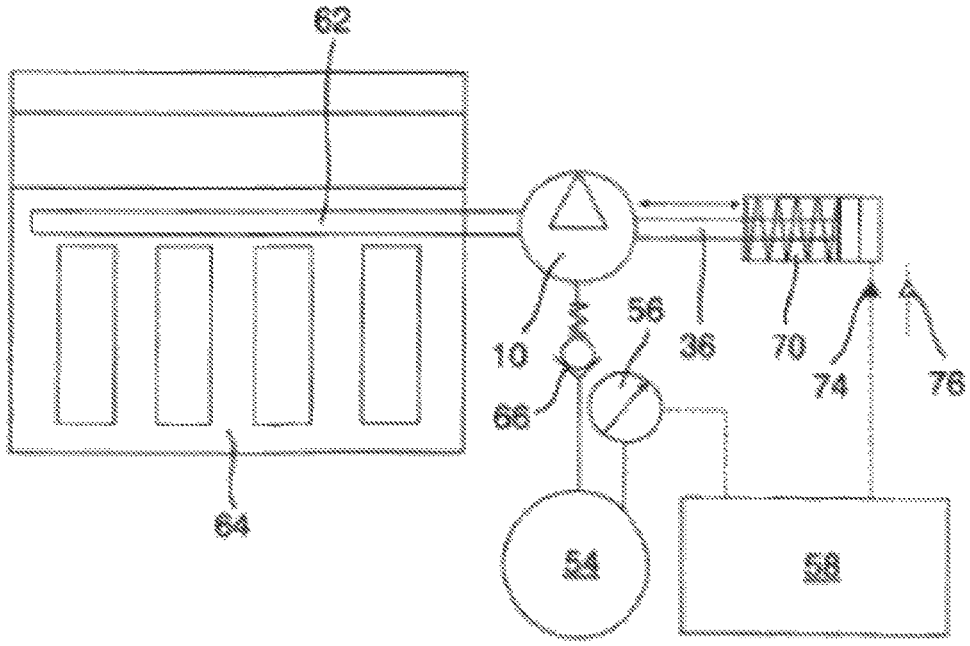
FIG. 17B shows a diagram for externally controlling hydraulically or pneumatically the locking mechanism when using a camshaft.

FIGS. 17*a* and 17*b* show a diagram for an external hydraulic or pneumatic control system of the locking mechanism 36, similar to the control system as shown in FIGS. 10*a* and 10*b*. The pressure in the brake booster 54 is acquired by the sensor 56 and transmitted to control electronics 58 which, on its part, controls the hydraulic or pneumatic vacuum control 70, which is indicated by arrows 74 and 76. As soon as a predetermined low pressure has been reached in the brake booster 54, the locking mechanism 36 is activated and the blades 16 are blocked in the rotor 14.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A displacement pump comprising a pot-shaped housing, a rotor swivel-mounted in the housing and at least one blade guided movably inside the rotor, wherein the blade tip contacts an inner peripheral wall of the housing and divides an internal space into chambers when the displacement pump is operating, and wherein a locking mechanism inhibits the displacement of the blade inside the rotor, wherein the locking mechanism engages the blade tractionally or frictionally, and a control element is located on the side of the housing which is moveable in axial direction via a drive system and which actuates the locking mechanism, wherein a rotation decoupling and an axial movement coupling are provided between the control element and the locking mechanism for decoupling rotational movement in the axial direction of the locking mechanism in relation to the control element on the side of the housing.

2. The displacement pump as set forth in claim 1, wherein in the rotor at least two blades arranged in parallel to one another are provided, wherein the blades, respectively, comprise a first section remaining in the rotor in such a way that the respective first sections overlap at least sectionwise perpendicularly to a displacement plane of the blades, and wherein the locking mechanism engages the first sections of the blades.

3. The displacement pump as set forth in claim 2, wherein the locking mechanism engages in a radial direction, at the respective first section of the blade.

4. The displacement pump as set forth in claim 2, wherein the locking mechanism is arranged in an intermediate space provided between the first sections of the blades and acts in radial direction on the broadsides of the first sections of the blades.

5. The displacement pump as set forth in claim 4, wherein the locking mechanism comprises a flexible blocking element, which is arranged in the intermediate space and which has a recess and an expansion element, which engages in the recess in such a way that when axially displaced the expansion element expands the blocking element in such a way that the blocking element acts on the broadsides of the first sections of the blades facing each other.

6. The displacement pump as set forth in claim 2, wherein the locking mechanism has a blocking element, which is arranged in axial extension of the blades and such that when the blocking element is axially displaced, the blocking element acts on the front ends of the blades arranged in at least one of parallel to one another or located in a plane.

7. The pump as set forth in claim 2, wherein the locking mechanism engages in an axial direction at the respective first section of the blade.

8. The pump as set forth in claim 2, wherein the locking mechanism engages in a radial direction and an axial direction at the respective first section of the blade.

9. The displacement pump as set forth in claim 1, wherein the rotation decoupling is formed by a ball.

10. The displacement pump as set forth in claim 1, wherein the axial movement coupling is formed by a ring element provided at the control element and an annular groove provided in at least one of the expansion element or the blocking element, which receives the ring element at least sectionwise.

11. The displacement pump as set forth in claim 1, wherein the locking mechanism is activated when the blade assumes its maximum retracted position in the rotor and the locking mechanism is deactivated when the rotor assumes a rotary position in which the blade tip of the locked blade shows the least distance from the inner peripheral wall.

* * * * *